US009773390B2

(12) United States Patent
Williams

(10) Patent No.: US 9,773,390 B2
(45) Date of Patent: Sep. 26, 2017

(54) AUTOMATIC HOME SAFETY BEACON DEVICE

(71) Applicant: Kevin Williams, Indianapolis, IN (US)

(72) Inventor: Kevin Williams, Indianapolis, IN (US)

( * ) Notice: Subject to any disclaimer, the term of this patent is extended or adjusted under 35 U.S.C. 154(b) by 0 days.

(21) Appl. No.: 14/947,448

(22) Filed: Nov. 20, 2015

(65) Prior Publication Data

US 2016/0148474 A1 May 26, 2016

Related U.S. Application Data

(60) Provisional application No. 62/084,828, filed on Nov. 26, 2014, provisional application No. 62/091,741, filed on Dec. 15, 2014.

(51) Int. Cl.

| | |
|---|---|
| ***G08B 3/00*** | (2006.01) |
| ***G08B 5/00*** | (2006.01) |
| ***G08B 7/00*** | (2006.01) |
| ***G08B 7/06*** | (2006.01) |
| ***G08B 1/08*** | (2006.01) |

(52) U.S. Cl.

CPC ..... *G08B 7/064* (2013.01); *G08B 1/08* (2013.01)

(58) Field of Classification Search

CPC ..... G08B 7/064; G08B 1/08
USPC ..... 340/691.5
See application file for complete search history.

(56) References Cited

U.S. PATENT DOCUMENTS 5,594,410 A * 1/1997 Lucas ..... G08B 7/062 340/328
7,385,517 B2 * 6/2008 Andres ..... G08B 7/06 340/506

* cited by examiner

*Primary Examiner* — Tanmay Shah
(74) *Attorney, Agent, or Firm* — C. John Brannon; Brannon Sowers & Cracraft PC

(57) ABSTRACT

A system for generating a visual home exterior alert in response to a home alarm, typically audio, including a light switch override portion operationally connected to a light switch for controlling outside lighting, and a listening portion positioned to detect an alarm sound. Upon detection of a predetermined alarm sound, the listening portion is actuated to send an enabling signal to the light switch override portion. Upon receipt of the enabling signal, the light switch override portion sequentially energizes and deenergizes the outside lighting in a predetermined pattern.

16 Claims, 5 Drawing Sheets

AUTOMATIC HOME SAFETY BEACON DEVICE

CROSS-REFERENCE TO RELATED APPLICATIONS

This patent application claims priority to U.S. Provisional Patent Application Ser. No. 62/084,828, filed on Nov. 26, 2014, and U.S. Provisional Patent Application Ser. No. 62/091,741, filed on Dec. 15, 2014.

TECHNICAL FIELD

The present novel technology relates generally to the field of electrical devices, and, more particularly, to a device for detecting alarm sounds and initiating a visual response.

BACKGROUND OF THE INVENTION

Most home alarm system sirens, whether alerting the homeowner to fire, break-in, intruders, or other emergencies, are located inside the home. The alarm, when sounded, is intended to alert the home's occupants to an emergency situation. The alarm is typically not intended to be heard outside the home. In the rare event that the alarm may be heard outside, it is not loud enough to be heard from the street or by the neighbors. Even if an emergency alarm is sounding inside the home, there is typically no way for anyone outside the house to become aware that there is anything wrong inside. Thus, neighbors and passersby are not early given the opportunity to provide aid and assistance as the emergency situation is first developing, at a time when many emergencies can be thwarted before a potential problem develops.

While there are some alarm systems that produce external lights or noises, these inevitably require dedicated lighting that must be installed on the exterior of the home. Such systems, while helpful, are expensive to purchase and install, require their own independent lighting fixtures, and mar the outward appearance of the home. Thus, there remains a need for alerting those outside the home that an emergency situation has arisen and has triggered an alarm that does not require additional dedicated lighting installation. The present novel technology addresses this need.

DETAILED DESCRIPTION

Figure 1:
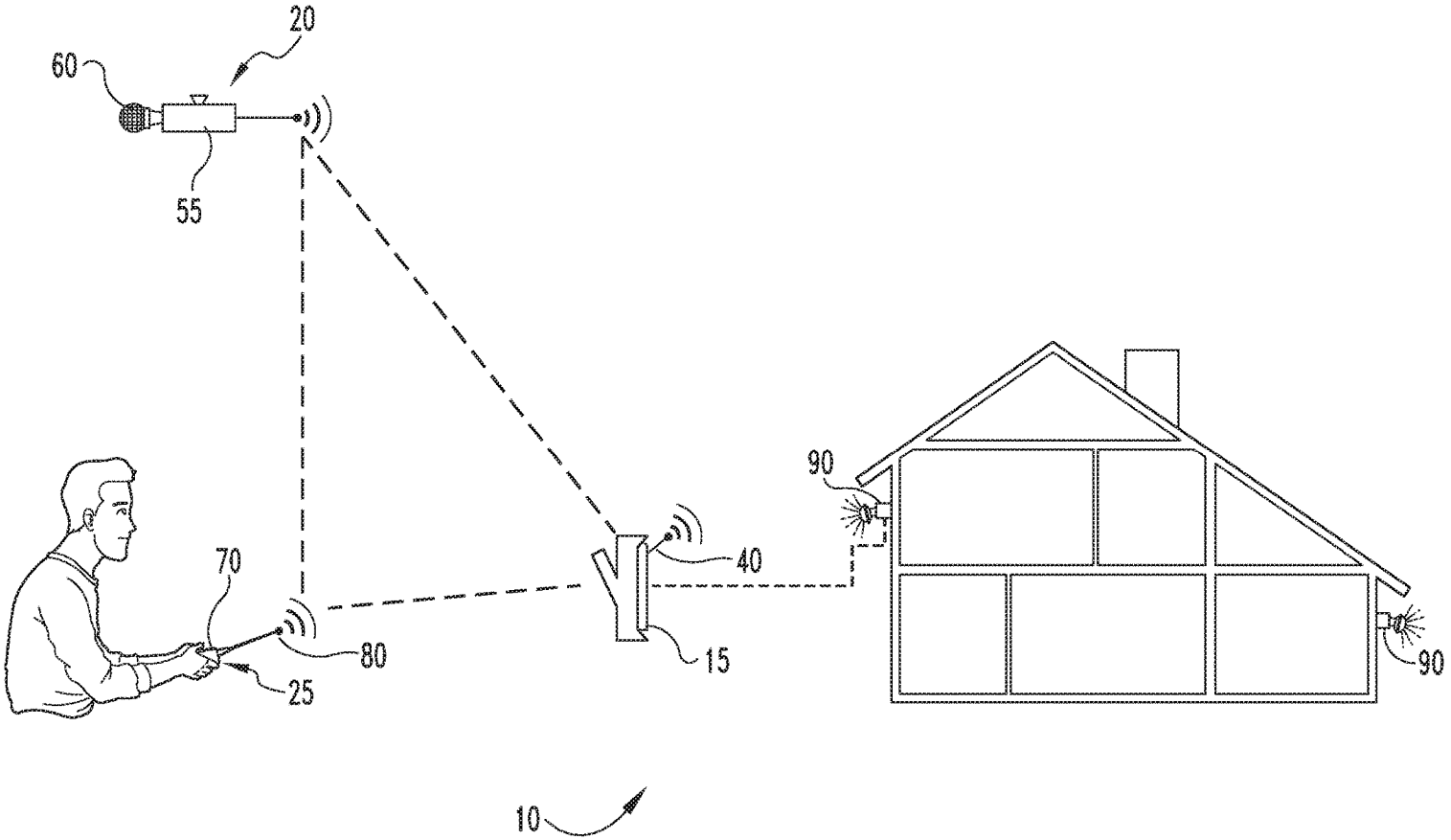
FIG. 1 is a schematic illustration of a system for flashing exterior or interior lighting in response to the sounding of an interior alarm according to a first embodiment of the present novel technology.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

As used herein, the phrase "transceiver" is typically a transmitting and receiving device, such as a two-way radio. But may also be solely a receiver or solely a transmitter.

Figure 2:
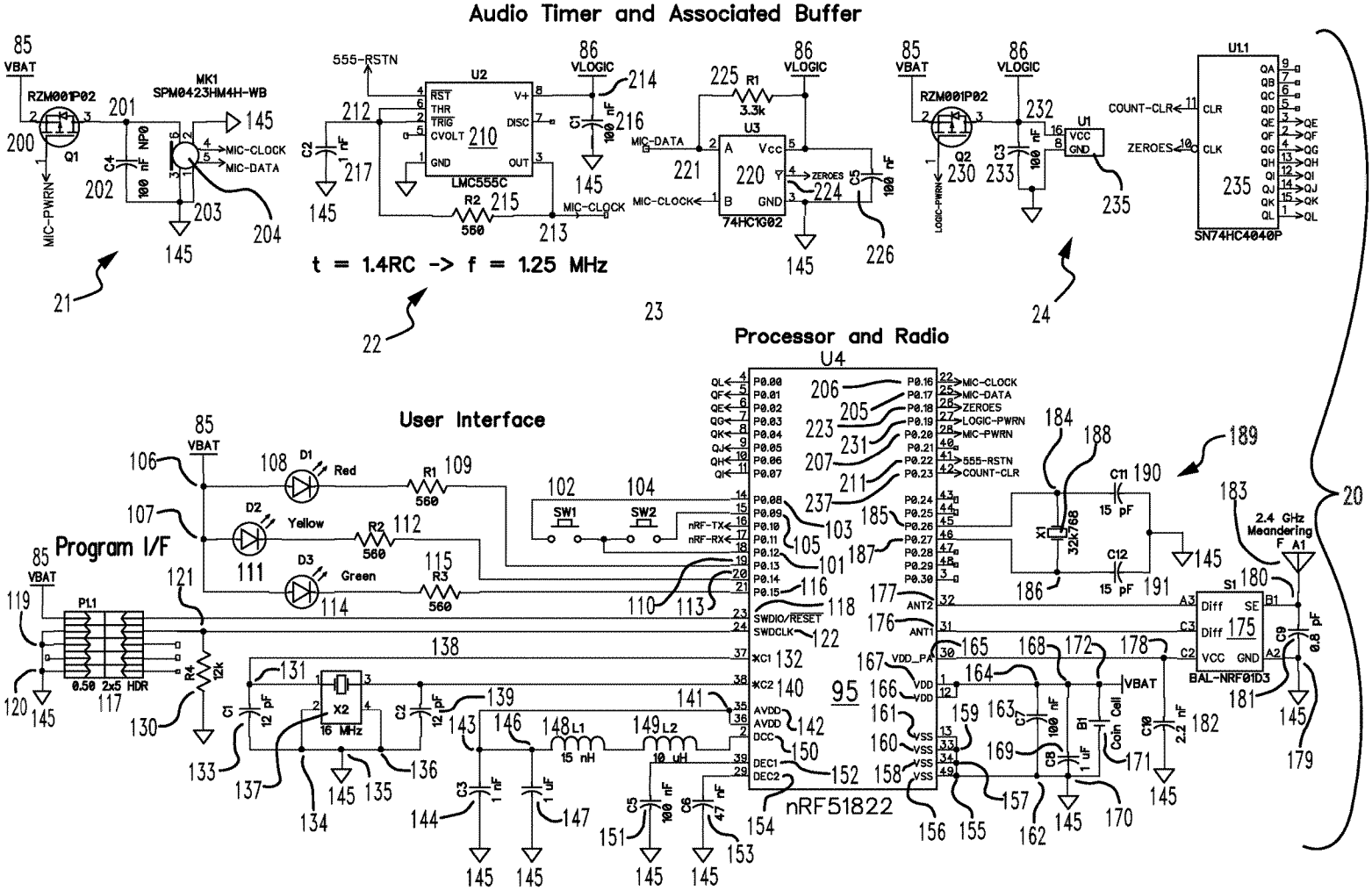
FIG. 2 is a circuit for monitoring an alarm and communicating with the circuit of FIG. 1, including subcircuits.
Figure 3:
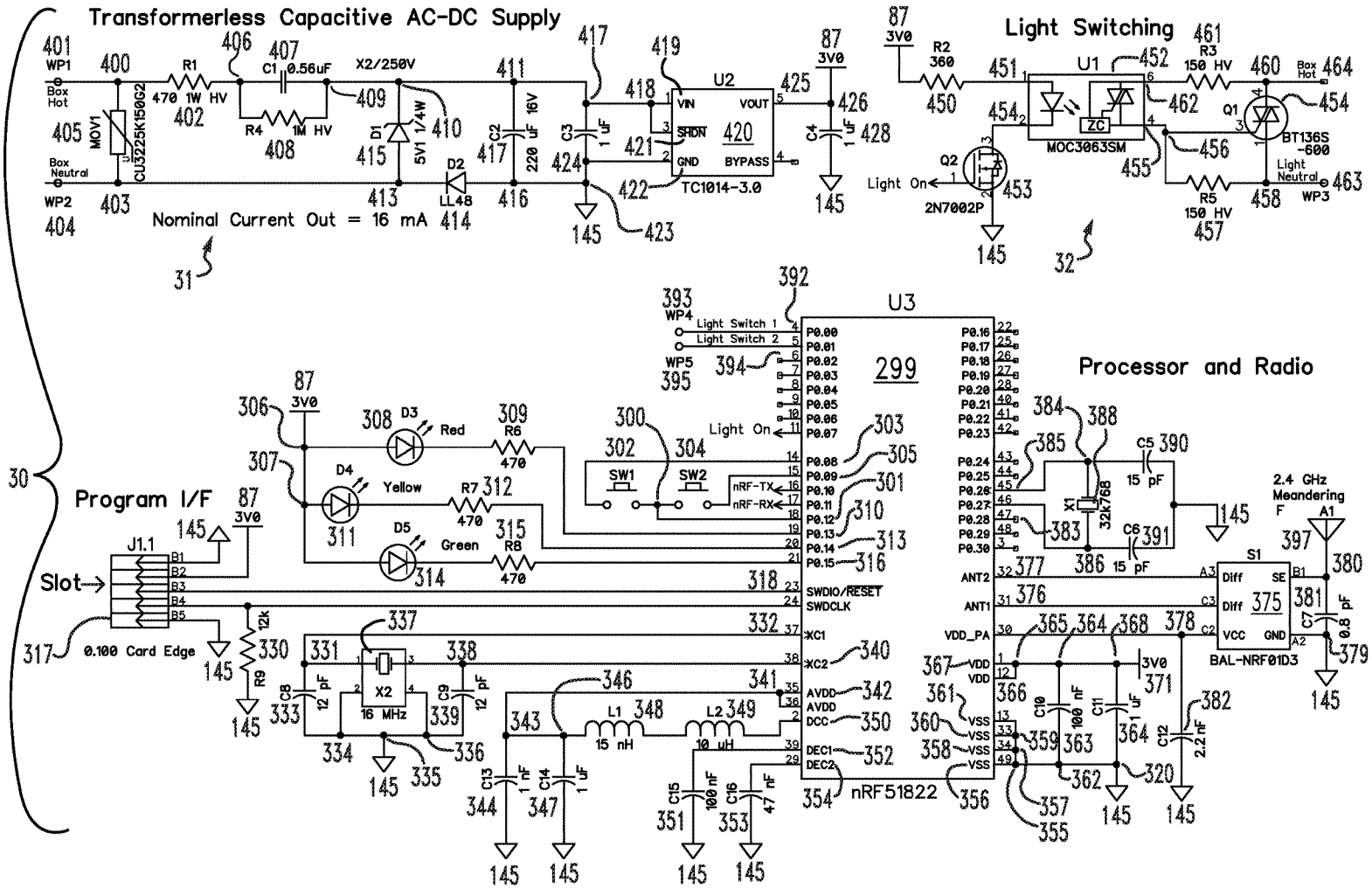
FIG. 3 is a schematic diagram of a circuit for controlling a switch, including subcircuits, according to the embodiment of FIG. 1
Figure 4:
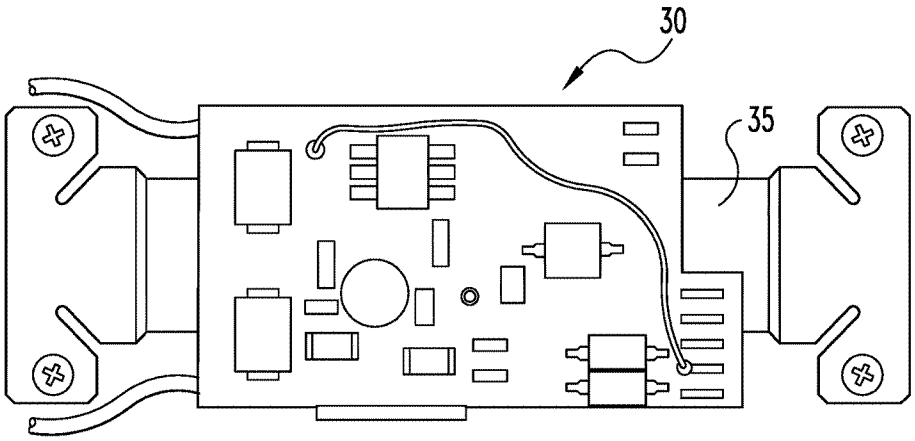
FIG. 4 is a back view of the circuit of FIG. 2 connected to a light switch.
Figure 5:
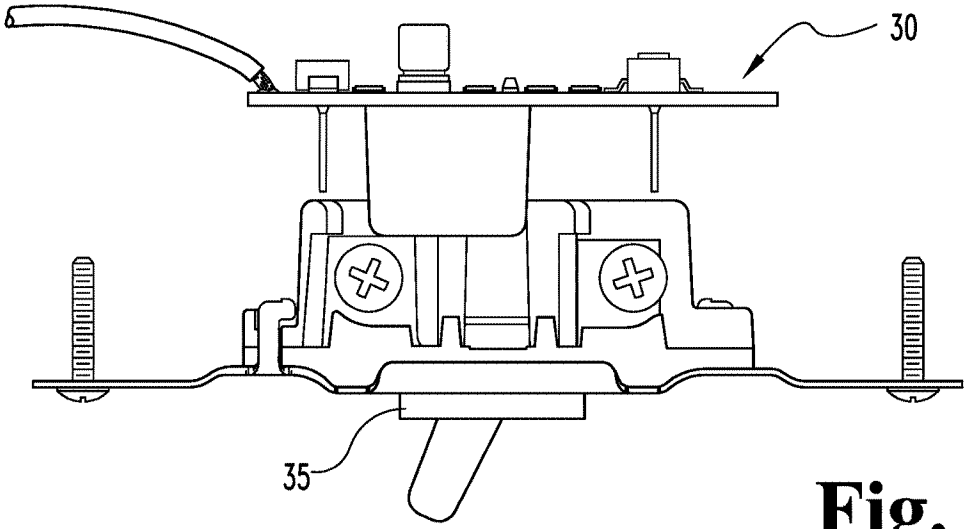
FIG. 5 is a side view of FIG. 4.

As illustrated in FIGS. 1-5, the present novel technology relates to a system 10 for overriding a light switch in the on or off position to energize lights on that were previously turned off, as well as to control the lights to blink in a predetermined pattern, such as a Morse code SOS signal pattern.

In one embodiment, the system includes an switch circuit portion 15, a listening circuit portion 20, and, typically, a user interface portion/remote control portion 25, which may be part of the switch circuit portion 15 or the listening portion 20, or may be a separate and independent unit. The switch circuit portion 15 includes an electric circuit 30 connectable to a switch 35. The switch 35 may be a toggle switch, such as a standard on/off light switch, a photoelectric switch, or the like. In some embodiments, the switch circuit portion 15 is integrally connected to a switch 35; in other embodiments, the switch circuit portion 15 is separate but connectible to a switch 35. The switch circuit portion 15 includes a switching circuit 30 and a transceiver 40 operationally connected thereto for radio or wireless communication with the listening circuit portion 20.

The listening circuit portion 20 typically includes a housing 50 with a listening circuit 55 disposed therein. The listening circuit 55 is operationally connected to a microphone 60, and also is operationally connected to a transceiver 65 for radio or wireless communication with the switch transceiver 40.

The remote control portion 25 includes a user interface 70, a radio circuit 75 connected thereto, and a transceiver 80 for communicating with the switch circuit portion 15 and/or the listening circuit portion 20.

The switch circuit portion 15 and the listening circuit portion 25 may include internal power supplies 85, such as batteries, operationally connected thereto to provide power to the circuit, or, alternately, may be directly connected to the respective switch 35 and/or alarm device to draw power therefrom.

The switch circuit 30 is configured to, upon receipt of an initializing signal from the listening circuit portion 25, automatically override the switch 35 to energize and deenergize the connected load 90, typically exterior or interior lighting, in a predetermined pattern.

The listening circuit 55 monitors audio alarms, and is typically configured to respond to audio alarms playing at or above a consistent and predetermined volume by transmitting an enabling signal to the switching circuit 30. The listening circuit 55 may likewise be configured to respond to alarms of predetermined frequencies and/or patterns and/or the like. The user interface/remote control portion 25 may be used to configure the listening circuit 55 as desired.

A plurality of listening portions 20 may be positioned adjacent or close to respective alarm units positioned in different locations and/or for responding to different types of emergencies. Each listening portion 20 is configured to send an enabling signal to one or more switching portions 15 connected to a switch 35 controlling a respective light fixture or lighting system.

Once enabled by receipt of the enabling signal, the switching circuit 30 overrides the manual switch 35 to alternately energize the light load 90 to flash a predetermined pattern, such as a Morse code SOS or the like, to get the attention of neighbors and/or passersby to alert them to the emergency so that help may be summoned.

In one embodiment, the listening circuit 55 includes a microprocessor or SoC 95, such as Nordic Semiconductor's NRF51822 smart chip, with node 100 electrically connected to pin eighteen 101. A first switch 102 is electrically connected between node 100 and the fourteenth pin 103. A second switch 104 is electrically connected between node 100 and the fifteenth pin 105. A voltage source 85 is electrically connected to node 106. Node 106 is electrically connected to a node 107 and a first (typically red) light emitting diode 108. The diode 108 is connected in electric communication with a first resistor 109, which is also electrically connected to the nineteenth pin 110. A second (typically yellow) light emitting diode 111 is electrically connected between node 107 and the second resistor 112, which is likewise electrically connected to the twentieth pin 113. A third (typically green) light emitting diode 114 is also electrically connected between node 107 and third resistor 115, which is electrically connected between the third diode 114 to the twenty-first pin 116.

A connector 117 is electrically connected to the twenty-third (SWDIO/RESET) pin 118, node 119, node 120, node 121, and voltage source 85. A fourth resistor 130 is electrically connected between node 121 and ground. Node 121 is electrically connected to the twenty-fourth (SWDCLK) pin 122.

Node 131 is electrically connected between pin thirty-seven (XC1) 132 and a first capacitor 133, which is connected between node 131 and node 134. Node 135 is connected between node 134 and node 136 and is also connected to common 145 or ground. An oscillator IC chip 137 is electrically connected to node 131, node 134, node 136, and node 138. A second capacitor 139 is electrically connected between node 138 and the thirty-eighth (XC2) pin 140.

Node 141 is electrically connected between pin thirty-five (AVDO) 142 and node 143. A third capacitor 144 is electrically connected between node 143 and ground or common 145. Node 146 is electrically connected to node 143, and a fourth capacitor 147 is electrically connected between node 146 and common 145. A first inductor 148 is electrically connected between node 146 and a second inductor 149, which in turn is electrically connected to pin two (DCC) 150. A fifth capacitor 151 is connected electrically between pin thirty-nine (DEC1) 152 and common 145, and a sixth capacitor 153 is electrically connected between pin twenty-nine (DEC2) 154 and common 145.

Node 155 is electrically connected to pin forty-nine (VSS) 156, node 157 is electrically connected to pin thirty-four (VSS) 158, and node 159 is electrically connected to pin thirty-three (VSS) 160 and pin thirteen (VSS) 161. Node 155, node 157, and node 159 are electrically connected to node 162. Seventh capacitor 163 is electrically connected between node 162 and node 164. Node 165 is electrically connected to node 164 and pin twelve (VDD) 166 and pin one (VDD) 167. Node 164 is electrically connected to node 168. Eighth capacitor 169 is electrically connected between node 168 and node 170. Node 170 is electrically connected to common 145. Coin cell 171 is electrically connected between node 172 (which is also electrically connected to node 168) and node 170. Node 172 is electrically connected to voltage source 85.

A signal conditioning or harmonic filter IC chip 175 is electrically connected to antenna pin thirty-one 176 and antenna pin thirty-two 177, and node 178, node 179, and node 180. A ninth capacitor 181 is electrically connected between nodes 179 and node 180, and a tenth capacitor 182 is electrically connected between node 178 and common 145. An antenna 183 is electrically connected to node 180.

Node 184 is electrically connected to pin forty-five 185 and node 186 is electrically connected to pin forty-six 187. An oscillator or piezoelectric crystal 188 is electrically connected between node 184 and node 186. Node 189 is connected to common 145, and eleventh and twelfth capacitors 190, 191 are connected between node 189 and respective node 184 and node 186.

The listening circuit 20 typically includes a microphone subcircuit 21 that typically includes a first MOSFET 200 electrically connected to a voltage source 85 and to node 201. Capacitor 202 is connected in electric communication with node 201 and node 203. Node 203 is electrically connected to common 145. Digital microphone 204 is electrically connected to node 201, node 203, pin twenty-five 205 of chip 95, pin twenty-two 206 of chip 95, and common 145. MOSFET 200 is likewise electrically connected to pin twenty-seven 207 of chip 95.

The listening circuit 20 also typically includes timer subcircuit 22, which typically includes a timer chip 210 electrically connected to pin forty-one of chip 95, node 212, common 145 or ground, node 213, and node 214. Resistor 215 is electrically connected between node 212 and node 213. Capacitor 216 is electrically connected between node 214 and common 145. Node 213 is electrically connected to pin 206. Node 214 is electrically connected to isolated voltage source 86. Capacitor 217 is electrically connected between node 212 and common 145.

The listening circuit 20 also typically includes buffer subcircuit 23, which typically includes a NOR gate chip 220 electrically connected to pin 206, node 221 (which is electrically connected to pin 205), node 222, pin eighteen 223 of chip 95, and node 224. Resistor 225 is electrically connected between node 221 and node 222, capacitor 226 is electrically connected between node 222 and node 224. Node 224 is electrically connected to common 145 or ground. Node 222 is also electrically connected to isolate voltage source 86.

The listening circuit 20 also typically includes a counter subcircuit 24 that typically includes a MOSFET 230 electrically connected to pin twenty-seven 231 of chip 95, voltage source 85, and node 232. Node 232 is electrically connected to voltage source 86, and capacitor 233. Capacitor 233 is electrically connected to common or ground 145. 12-bit asynchronous binary counter chip 235 is electrically connected to node 232, node 233, pin 223, and pin 237 of chip 95.

The switching circuit 30 typically includes an SoC 299, such as Nordic Semiconductor's NRF51822 smart chip, with node 300 electrically connected to pin eighteen 301. A switch 302 is electrically connected between node 300 and the fourteenth pin 303. A second switch 304 is electrically connected between node 300 and the fifteenth pin 305. A low voltage source 87 is electrically connected to node 306. Node 306 is electrically connected to a node 307 and diode 308. The diode 308 is connected in electric communication with resistor 309, which is also electrically connected to the nineteenth pin 310. A second diode 311 is electrically connected between node 307 and the second resistor 312, which is likewise electrically connected to the twentieth pin 313. A third diode 314 is also electrically connected between node 307 and third resistor 115, which is electrically connected between the third diode 314 to the twenty-first pin 316.

A connector 317 is electrically connected to the twenty-third pin 318, node 321, common 145, and voltage source 87. A resistor 330 is electrically connected between node 321 and common 145 or ground.

Node 331 is electrically connected between pin thirty-seven 332 and capacitor 333, which is connected between node 331 and node 334. Node 335 is connected between node 334 and node 336 and is also connected to common 145 or ground. An oscillator IC chip 337 is electrically connected to node 331, node 334, node 336, and node 338. A second capacitor 339 is electrically connected between node 338 and the thirty-eighth pin 340.

Node 341 is electrically connected between pin thirty-five 342 and node 343. A third capacitor 344 is electrically connected between node 343 and ground or common 145. Node 346 is electrically connected to node 343, and a fourth capacitor 347 is electrically connected between node 346 and common 145. A first inductor 348 is electrically connected between node 346 and a second inductor 349, which in turn is electrically connected to pin two 350. A fifth capacitor 351 is connected electrically between pin thirty-nine 352 and common 145, and a sixth capacitor 353 is electrically connected between pin twenty-nine 354 and common 145.

Node 355 is electrically connected to pin forty-nine 356, node 357 is electrically connected to pin thirty-four 358, and node 359 is electrically connected to pin thirty-three 360 and pin thirteen 361. Node 355, node 357, and node 359 are electrically connected to node 362. Seventh capacitor 363 is electrically connected between node 362 and node 364. Node 365 is electrically connected to node 364 and pins twelve 366 and one 367. Node 364 is electrically connected to node 368. Eighth capacitor 369 is electrically connected between node 368 and node 370. Node 370 is electrically connected to common 145.

A signal conditioning or harmonic filter IC chip 375 is electrically connected to antenna pin thirty-one 376 and antenna pin thirty-two 377, and node 378, node 379, and node 380. A ninth capacitor 381 is electrical connected between nodes 379 and node 380, and a tenth capacitor 382 is electrically connected between node 378 and common 145. An antenna 397 is electrically connected to node 380.

Node 384 is electrically connected to pin forty-five 385 and node 386 is electrically connected to pin forty-six 387. An oscillator or piezoelectric crystal 388 is electrically connected between node 384 and node 386. Node 389 is connected to common 145, and eleventh and twelfth capacitors 390, 391 are connected between node 389 and respective node 384 and node 386.

Pin four 392 is electrically connected to wiring point 393 associated with a first light switch terminal, and pin five 394 is electrically connected to wiring point 395 associated with a second light switch terminal. Antenna 397 is electrically connected to node 380.

Switch circuit 30 typically includes AC-DC supply subcircuit 31 which typically includes node 400 electrically connected between wiring point 401 (associated with box hot) and resistor 402. Node 403 is electrically connected to wiring point 404 (associated with box neutral). Varistor 405 is electrically connected between node 400 and node 403. Resistor 402 is electrically connected between node 402 and node 406. Capacitor 407 and resistor 408 are electrically connected in parallel between node 406 and node 409. AC-DC subcircuit 31 typically provides a nominal output current of about 16 mA.

Node 410 is electrically connected between node 409 and node 411. Node 413 is electrically connected between node 403 and diode 414. Zener diode 415 is electrically connected between node 410 and node 413. Diode 414 is electrically connected between node 403 and node 416. Capacitor 417 is electrically connected between node 411 and node 416. Node 418 is electrically connected between node 418 and VIN pin 419 of voltage regulator IC 420. SHDN pin 421 is electrically connected to node 418 and GND pin 422 is electrically connected to node 423, which is likewise connected to node 416 and common 145. Capacitor 425 is electrically connected between node 417 and node 423. VOUT pin 425 is electrically connected to node 426, which is also electrically connected between low voltage input 87 and capacitor 428. Capacitor 428 is electrically connected between node 426 and common 145.

Switch circuit 30 typically includes light switching subcircuit 32 which typically includes a resistor 450 electrically connected between a low voltage source 87 and pin one 451 of an SCR output optocoupler chip 452. A MOSFET 453 is electrically connected between pin two 454 and common 145. Pin 455 is electrically connected to node 456. Resistor 457 is electrically connected between node 456 and node 458. Diac 459 is electrically connected between node 458 and node 460. Node 458 is electrically connected to wiring point 463 (associated with light neutral) and node 460 is electrically connected with wiring point 464 (associated with box hot).

In one embodiment, the circuit elements have the following values:

| | | | | | |
|---|---|---|---|---|---|
| R109 | 560 Ω | R215 | 560 Ω | Antenna 397 | 2.4 GHZ meandering |
| R112 | 560 Ω | C216 | 100 nF | C390 | 15 pF |
| R115 | 560 Ω | R225 | 3.3K Ω | C391 | 15 pF |
| R130 | 12K Ω | IC220 | 74HC1G02 | Varistor 405 | CU3225K15062 |
| C133 | 12 pF | C226 | 100 nF | R402 | 470 Ω 1 W HV |
| C139 | 12 pF | MOSFET 230 | RZM001P02 | R408 | 1M Ω HV |
| C144 | 1 nF | C233 | 100 nF | C407 | 0.56 μF |
| C147 | 1 μF | IC 235 | SN74HC4040P | D415 | 5 V 1¼ W |
| L148 | 15 nH | R309 | 470 Ω | D414 | LL48 |
| L149 | 10 μH | R312 | 470 Ω | C417 | 220 μF |
| C151 | 100 nF | R315 | 470 Ω | C424 | 1 μF |
| C152 | 47 nF | R330 | 12K Ω | IC 428 | TC1014-3.6 |
| C163 | 100 nF | C333 | 12 pF | C428 | 1 μF |
| C169 | 1 μF | C329 | 12 pF | R430 | 360 Ω |
| C182 | 2.2 nF | C344 | 1 nF | MOSFET 453 | 2N7002P |
| C181 | 0.8 pF | C347 | 1 μF | SCR 452 | MOC3063SM |
| C190 | 15 pF | L348 | 15 nH | R461 | 150 Ω HV |

-continued

| | | | | | |
|---|---|---|---|---|---|
| C191 | 15 pF | L349 | 10 μH | DIAC454 | BT136S-600 |
| IC 175 | BAL-NRF01D3 | C351 | 100 nF | R457 | 150 Ω HV |
| Antenna 183 | 2.4 GHz Meandering | C353 | 47 nF | | |
| MOSFET 200 | RZM001P02 | C363 | 100 nF | | |
| Mik 204 | SPM0423HM4H | C369 | 1 μF | | |
| IC210 | LMC555C | C381 | 0.8 pF | | |
| C217 | 1 nF | C382 | 2.2 nF | | |

In operation, the switch portion 15 is operationally connected to an existing light switch 35 (toggle type, photocell, or the like) such that when the circuit 30 is not enabled by receipt of an enabling signal, the switch functions normally. One or more listening portions 20 are positioned to monitor the audio speaker elements of one or more emergency alarms, such as smoke detectors, burglar alarms, or the like. The listening portions 20 send an enabling signal to the switch portions 15 when they detect an audio signal meeting a predetermined set of criteria. Once enabled, the circuit 30 overrides and bypasses the switch 35 and sequentially energizes and deenergizes the lights normally controlled by the switch 35 in a predetermined distress or alert pattern. The distress pattern is typically enabled until the switch portion 15 receives a reset or cancellation signal input through the user interface 70. In some embodiments, the enabling signal may be manually sent from the remote control 25.

In other embodiments, the switch portion 15 is provided already connected to a switch 35 for original installation. In some embodiments, the switch portion 15 may be connected directly to a power source, such as a standard 120V AC electrical outlet. In other embodiments, the user interface 25 may include a low battery indicator, on/off switch, signal strength indicator, and an on/off length of time feature after a signal is detected, an emergency call button, and/or a test button. In other embodiments, the user interface 25 is part of a mobile telephone app. The emergency call feature, when actuated, may signal the switch portion 15 to override the lighting to flash the predetermined emergency sequence, and may also initiate a predetermined emergency message via the 911 emergency system or the like.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

I claim:

1. A system for providing a home visual alert in response to a home interior audio alarm, comprising:

a light switch override portion operationally connected to a light switch for controlling lighting;

a listening portion positioned to detect an alarm sound;

wherein the light switch override portion further comprises:

a microprocessor;

a first node electrically connected to the microprocessor;

a first switch electrically connected between the first node and the microprocessor;

a second node electrically connected between the first node and the microprocessor;

a second node electrically connected to a low voltage source, a third node and a first diode;

a first resistor electrically connected to first diode and the microprocessor;

a second diode electrically connected between the third node and a second resistor, wherein the second resistor is electrically connected between the second diode and the microprocessor;

a third diode electrically connected between the third node and a third resistor, wherein the third resistor is electrically connected between the third diode and the microprocessor;

a connector electrically connected to a fourth node, common, and first low voltage source;

a fourth resistor is electrically connected between the fourth node and common;

a fifth node is electrically connected between the microprocessor and a first capacitor, wherein the first capacitor is electrically connected between the fifth node and a sixth node;

a seventh node is connected in electric communication between the sixth node and an eighth node and is also connected to common;

an oscillator IC chip is electrically connected to the fifth node, the sixth node, the eighth node, and a ninth node;

a second capacitor is electrically connected between the ninth node and the microprocessor;

a tenth node is electrically connected between the microprocessor and an eleventh node;

a third capacitor is electrically connected between the eleventh node and common;

a twelfth node is electrically connected to the eleventh node;

a fourth capacitor is electrically connected between the twelfth node and common;

a first inductor is electrically connected between the twelfth node and a second inductor, wherein the second inductor is electrically connected to the microprocessor;

a fifth capacitor is connected electrically between the microprocessor and common;

a sixth capacitor is electrically connected between the microprocessor and common;

a thirteenth node is electrically connected to the microprocessor;

a fourteenth node is electrically connected to the microprocessor;

a fifteenth node is electrically connected to the microprocessor;

the thirteenth, fourteenth and fifteenth nodes are electrically connected to a sixteenth node;

a seventh capacitor is electrically connected between the sixteenth node and a seventeenth node;

an eighteenth node is electrically connected to the seventeenth node and the microprocessor;

a nineteenth node is electrically connected to the eighteenth node;

an eighth capacitor is electrically connected between the nineteenth node and a twentieth node;

the twentieth node is electrically connected to common;

a harmonic filter IC chip is electrically connected to the microprocessor and a twenty-first node, a twenty-second node, and a twenty-third node;

a ninth capacitor is electrical connected between the twenty-second node and the twenty-third node;

a tenth capacitor is electrically connected between the twenty-first node and common;

an antenna is electrically connected to the twenty-third node;

a twenty-fourth node is electrically connected to the microprocessor;

a twenty-fifth node is electrically connected to the microprocessor;

an oscillator is electrically connected between the twenty-fourth node and the twenty-fifth node;

a twenty-sixth node is connected to common;

eleventh and twelfth capacitors are connected between the twenty-sixth node and the respective twenty-fourth and twenty-fifth nodes;

the microprocessor is electrically connected to wiring point for connection to a first side of a light switch; and the microprocessor is electrically connected to wiring point for connection to a second, opposite side of a light switch;

wherein upon detection of a predetermined alarm sound, the listening portion is actuated to send an enabling signal to the light switch override portion;

wherein upon receipt of the enabling signal, the light switch override portion sequentially energizes and deenergizes the lighting in a predetermined pattern.

2. The system of claim 1 wherein the lighting is outside lighting.

3. The system of claim 1 and further comprising a control interface operationally connected to the light switch override portion.

4. The system of claim 3 wherein the control interface is integral with a remote control portion, and wherein the remote control portion further comprises a transceiver for communicating with the light switch override portion.

5. The system of claim apparatus of claim 4 wherein the transceiver may communicate with the listening portion.

6. The device of claim 1, wherein the low voltage source is 3V DC output from the custom power supply.

7. A system for engaging lighting to provide a visual alert in response to a home interior alarm, comprising:

a switch;

a power source electrically connected to the switch;

lighting electrically connected to the switch;

a light switch override circuit connected in electric communication to a switch for controlling lighting, further comprising;

a microprocessor;

a first node electrically connected to the microprocessor;

a first switch electrically connected between the first node and the microprocessor;

a second node electrically connected between the first node and the microprocessor;

a second node electrically connected to a low voltage source, a third node and a first diode;

a first resistor electrically connected to first diode and the microprocessor;

a second diode electrically connected between the third node and a second resistor, wherein the second resistor is electrically connected between the second diode and the microprocessor;

a third diode electrically connected between the third node and a third resistor, wherein the third resistor is electrically connected between the third diode and the microprocessor;

a connector electrically connected to a fourth node, common, and first low voltage source;

a fourth resistor is electrically connected between the fourth node and common;

a fifth node is electrically connected between the microprocessor and a first capacitor, wherein the first capacitor is electrically connected between the fifth node and a sixth node;

a seventh node is connected in electric communication between the sixth node and an eighth node and is also connected to common;

an oscillator IC chip is electrically connected to the fifth node, the sixth node, the eighth node, and a ninth node;

a second capacitor is electrically connected between the ninth node and the microprocessor;

a tenth node is electrically connected between the microprocessor and an eleventh node;

a third capacitor is electrically connected between the eleventh node and common;

a twelfth node is electrically connected to the eleventh node;

a fourth capacitor is electrically connected between the twelfth node and common;

a first inductor is electrically connected between the twelfth node and a second inductor, wherein the second inductor is electrically connected to the microprocessor;

a fifth capacitor is connected electrically between the microprocessor and common;

a sixth capacitor is electrically connected between the microprocessor and common;

a thirteenth node is electrically connected to the microprocessor;

a fourteenth node is electrically connected to the microprocessor;

a fifteenth node is electrically connected to the microprocessor;

the thirteenth, fourteenth and fifteenth nodes are electrically connected to a sixteenth node;

a seventh capacitor is electrically connected between the sixteenth node and a seventeenth node;

an eighteenth node is electrically connected to the seventeenth node and the microprocessor;

a nineteenth node is electrically connected to the eighteenth node;

an eighth capacitor is electrically connected between the nineteenth node and a twentieth node;

the twentieth node is electrically connected to common;

a harmonic filter IC chip is electrically connected to the microprocessor and a twenty-first node, a twenty-second node, and a twenty-third node;

a ninth capacitor is electrical connected between the twenty-second node and the twenty-third node;

a tenth capacitor is electrically connected between the twenty-first node and common;

an antenna is electrically connected to the twenty-third node;

a twenty-fourth node is electrically connected to the microprocessor;

a twenty-fifth node is electrically connected to the microprocessor;

an oscillator is electrically connected between the twenty-fourth node and the twenty-fifth node;

a twenty-sixth node is connected to common;

eleventh and twelfth capacitors are connected between the twenty-sixth node and the respective twenty-fourth and twenty-fifth nodes;

the microprocessor is electrically connected to wiring point for connection to a first side of a light switch; and the microprocessor is electrically connected to wiring point for connection to a second, opposite side of a light switch;

a receiver operationally connected to the light switch override circuit;

a sensor positioned to detect an alarm signal;

a listening circuit operationally connected to the sensor;

a transceiver operationally connected to the listening circuit;

wherein upon detection of a predetermined alarm signal, the listening circuit is engaged to send an enabling signal to the light switch override circuit;

wherein upon receipt of the enabling signal, the light switch override circuit sequentially energizes and deenergizes the lighting in a predetermined pattern.

8. The system of claim 7 wherein the lighting is positioned on the exterior of a house.

9. The system of claim 7 and further comprising a control interface operationally connected to the light switch override circuit.

10. The system of claim 9 wherein the control interface is part of a remote control unit, and wherein the remote control unit further comprises a remote transceiver for communicating with the light switch override circuit.

11. The system of claim apparatus of claim 10 wherein the remote transceiver may communicate with the listening circuit.

12. The system of claim 7 wherein the light switch override circuit is powered by the power source.

13. The system of claim 7 wherein the light switch override circuit and the listening circuit each have their own independent power source.

14. The system of claim 7 wherein the sensor is a microphone.

15. A kit for adapting home lighting to provide a visual alert in response to a home interior alarm, comprising:

a switch override circuit assembly, further comprising;

a first circuit for overriding a light switch to control connected lighting to energize and deenergize in a predetermined pattern; and a first transceiver connected in electric communication with the first circuit;

an alarm monitoring assembly, further comprising:

an audio sensor;

a second transceiver; and a second circuit operationally connected to the second transceiver and operationally connected to the audio sensor for sending a signal to the first circuit upon detection of a predetermined audio alarm signal;

wherein the first circuit further comprises:

a microprocessor;

a first node electrically connected to the microprocessor;

a first switch electrically connected between the first node and the microprocessor;

a second node electrically connected between the first node and the microprocessor;

a second node electrically connected to a low voltage source, a third node and a first diode;

a first resistor electrically connected to first diode and the microprocessor;

a second diode electrically connected between the third node and a second resistor, wherein the second resistor is electrically connected between the second diode and the microprocessor;

a third diode electrically connected between the third node and a third resistor, wherein the third resistor is electrically connected between the third diode and the microprocessor;

a connector electrically connected to a fourth node, common, and first low voltage source;

a fourth resistor is electrically connected between the fourth node and common;

a fifth node is electrically connected between the microprocessor and a first capacitor, wherein the first capacitor is electrically connected between the fifth node and a sixth node;

a seventh node is connected in electric communication between the sixth node and an eighth node and is also connected to common;

an oscillator IC chip is electrically connected to the fifth node, the sixth node, the eighth node, and a ninth node;

a second capacitor is electrically connected between the ninth node and the microprocessor;

a tenth node is electrically connected between the microprocessor and an eleventh node;

a third capacitor is electrically connected between the eleventh node and common;

a twelfth node is electrically connected to the eleventh node;

a fourth capacitor is electrically connected between the twelfth node and common;

a first inductor is electrically connected between the twelfth node and a second inductor, wherein the second inductor is electrically connected to the microprocessor;

a fifth capacitor is connected electrically between the microprocessor and common;

a sixth capacitor is electrically connected between the microprocessor and common;

a thirteenth node is electrically connected to the microprocessor;

a fourteenth node is electrically connected to the microprocessor;

a fifteenth node is electrically connected to the microprocessor;

the thirteenth, fourteenth and fifteenth nodes are electrically connected to a sixteenth node;

a seventh capacitor is electrically connected between the sixteenth node and a seventeenth node;

an eighteenth node is electrically connected to the seventeenth node and the microprocessor;

a nineteenth node is electrically connected to the eighteenth node;

an eighth capacitor is electrically connected between the nineteenth node and a twentieth node;

the twentieth node is electrically connected to common;

a harmonic filter IC chip is electrically connected to the microprocessor and a twenty-first node, a twenty-second node, and a twenty-third node;

a ninth capacitor is electrical connected between the twenty-second node and the twenty-third node;

a tenth capacitor is electrically connected between the twenty-first node and common;

an antenna is electrically connected to the twenty-third node;

a twenty-fourth node is electrically connected to the microprocessor;

a twenty-fifth node is electrically connected to the microprocessor;

an oscillator is electrically connected between the twenty-fourth node and the twenty-fifth node;

a twenty-sixth node is connected to common;

eleventh and twelfth capacitors are connected between the twenty-sixth node and the respective twenty-fourth and twenty-fifth nodes;

the microprocessor is electrically connected to wiring point for connection to a first side of a light switch; and the microprocessor is electrically connected to wiring point for connection to a second, opposite side of a light switch.

16. The kit of claim 15 and further comprising a remote control assembly, wherein the remote control assembly further comprises:

a third transceiver;

a power source;

a control circuit; and a control interface operationally connected to the control circuit, the third transceiver and the power source.

* * * * *